US006683591B2

(12) United States Patent
Hashimoto et al.

(10) Patent No.: US 6,683,591 B2
(45) **Date of Patent: *Jan. 27, 2004**

(54) METHOD FOR DRIVING LIQUID CRYSTAL DISPLAY DEVICE

(75) Inventors: Seiji Hashimoto, Yokohama (JP); Shigetoshi Sugawa, Atsugi (JP); Shigeki Kondo, Hiratsuka (JP); Takayuki Ishii, Hiratsuka (JP); Kazuyuki Shigeta, Atsugi (JP); Koichi Sono, Hiratsuka (JP); Daisuke Yoshida, Atsugi (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 5 days.

(21) Appl. No.: 09/459,480

(22) Filed: Dec. 13, 1999

(65) Prior Publication Data

US 2002/0105489 A1 Aug. 8, 2002

Related U.S. Application Data

(62) Division of application No. 08/841,823, filed on Apr. 28, 1997, which is a continuation of application No. 08/370,453, filed on Jan. 9, 1995, now abandoned, which is a continuation of application No. 08/233,404, filed on Apr. 26, 1994, now abandoned.

(30) Foreign Application Priority Data

Apr. 28, 1993 (JP) ..... 5-102731

(51) Int. Cl.[7] ..... G09G 3/36

(52) U.S. Cl. ..... 345/87; 345/51; 345/55; 345/67; 345/98; 345/99; 345/100; 345/204; 345/209; 345/210; 349/143; 349/149; 349/151

(58) Field of Search ..... 345/87, 67, 55, 345/51, 204, 209, 210, 98, 99, 100; 349/143, 149, 151

(56) References Cited

U.S. PATENT DOCUMENTS

| | | | | | |
|---|---|---|---|---|---|
| 4,206,386 | A | * | 6/1980 | Akutsu | 315/169 |
| 4,386,352 | A | | 5/1983 | Nonomura et al. | 345/92 |
| 4,393,380 | A | | 7/1983 | Hosokawa et al. | 345/95 |
| 4,429,305 | A | * | 1/1984 | Hosokawa et al. | 340/784 |
| 4,789,223 | A | * | 12/1988 | Kasahara et al. | 340/784 |
| 4,795,239 | A | * | 1/1989 | Yamashita et al. | 340/784 |
| 4,999,618 | A | * | 3/1991 | Inada et al. | 340/781 |
| 5,105,288 | A | * | 4/1992 | Senda et al. | 340/784 |
| 5,151,805 | A | | 9/1992 | Takeda et al. | 359/57 |
| 5,477,243 | A | * | 12/1995 | Tamura | 347/12 |
| 5,528,396 | A | * | 6/1996 | Someya et al. | 359/59 |
| 5,682,177 | A | * | 10/1997 | Kuwata et al. | 345/100 |
| 5,686,932 | A | * | 11/1997 | Tomita | 345/94 |
| 5,706,123 | A | * | 1/1998 | Miller et al. | 359/291 |
| 5,784,073 | A | * | 7/1998 | Yamazaki et al. | 345/508 |
| 5,828,354 | A | * | 10/1998 | Ebihara | 345/58 |

FOREIGN PATENT DOCUMENTS

| | | |
|---|---|---|
| JP | 54-98525 | 8/1979 |
| JP | 1-138590 | 5/1989 |

* cited by examiner

*Primary Examiner*—Richard Hjerpe
*Assistant Examiner*—Abbas I Abdulselam
(74) *Attorney, Agent, or Firm*—Fitzpatrick, Cella, Harper & Scinto

(57) ABSTRACT

For enabling a liquid display drive with a low voltage and a high speed, each pixel is provided with a liquid crystal cell 5, a switching transistor 7 and an additional capacitance 9, and the additional capacitances are electrically commonly connected for a block of plural pixels. After the image signal is supplied to the pixels corresponding to the block, the potential of desired one of the common electrode lines 52, 52', to which the additional capacitances 9 corresponding to the block are connected, is varied and retained at thus varied value.

8 Claims, 9 Drawing Sheets

METHOD FOR DRIVING LIQUID CRYSTAL DISPLAY DEVICE

This application is a division of application Ser. No. 08/841,823, filed Apr. 28, 1997, which is a continuation of application Ser. No. 08/370,453, filed Jan. 9, 1995, abandoned, which is a continuation of application Ser. No. 08/233,404, filed Apr. 26, 1994, abandoned.

BACKGROUND OF THE INVENTION

1. Field of the Invention

The present invention relates to a method for driving a liquid crystal display device, and more particularly to a method for driving a matrix liquid crystal display device having plural pixels arranged in a matrix.

2. Related Background Art

In recent years, the liquid crystal display devices are commercialized in various fields such as display for a word processor, a personal computer or the like, electronic view finder for a video camera, projection television or displays for an automobile. Also there is being required image display of a larger size, a higher resolution and a higher image quality.

FIG. 1 schematically shows the configuration of such liquid crystal display device, applied for a television receiver.

In FIG. 1 there are shown a vertical shift register 10; a horizontal shift register 20; switching transistors 22; a common signal line 24; a signal inverting circuit 30; a clock generator circuit 40; a liquid crystal display panel 100; address signal lines $V_1$, $V_2$, . . . , $V_{m-1}$, $V_m$; vertical data signal lines $D_1$, $D_2$, . . . , $D_n$; a signal S bearing image information; and an output signal S' bearing image information, released from the signal inverting circuit 30.

The vertical data signal lines $D_1$–$D_n$ are connected, respectively through the horizontal transfer switches 22, to the signal line 24, and the gates of the horizontal transfer switches 22 receive signals from the horizontal shift register 20, in response to the signal from the clock generator circuit 40. The signal from the clock generator circuit 40 is also supplied to the vertical shift register 10, thus driving the address signal lines $V_1$–$V_m$ in succession in synchronization with the signal S. The signal from the clock generator circuit 40 is further supplied to the signal inverting circuit 30, thereby inverting the signal S in synchronization therewith. The clock generator circuit 40 is given an unrepresented synchronization signal, prepared from the image information bearing signal S, in order to achieve synchronization with the signal S.

In this manner the vertical shift register 10, the horizontal shift register 20 and the signal inverting circuit 30 effect the desired television scanning operation, by means of the pulses prepared by the clock generator 40.

In the liquid crystal panel 100, a row of pixels is selected by the address signal lines $V_1$–$V_m$ from the vertical shift register 10, and the vertical data signal lines $D_1$–$D_n$ are selected by the successive activations of the horizontal transfer switches 22 by driving pulses $H_1$–$H_m$ from the horizontal shift register 20, whereby image signals are supplied to the respective pixels.

As explained in the foregoing, the input terminals of the horizontal transfer switches 22 are connected, through the common signal line 24, to the signal inverting circuit 30, which is provided for converting the input image signal into an AC drive signal, in order to prevent deterioration in the characteristics of the liquid crystal. For AC driving of liquid crystal, there are already known various methods such as frame inversion, field inversion, 1H (horizontal scanning period) inversion and bit (every pixel) inversion.

FIG. 2 is an equivalent circuit of the liquid crystal panel 100 shown in FIG. 1. In FIG. 2, there are only shown four pixels driven with the data signal lines $D_1$, $D_2$ and the address signal lines $V_1$, $V_2$ within the liquid crystal panel 100.

Referring to FIG. 2, there are shown liquid crystal pixels 5; switching transistors 7 respectively attached to the pixels; common electrode lines 16; and additional capacitances 9. Electrodes of the liquid crystal pixel 5 and the additional capacitance 9 are electrically connected to the output side of the respective switching transistor 7, and the other electrodes are connected to the common electrode line 16. The input terminals of the switching transistors 7 are electrically connected, in groups of respective vertical columns of pixels, to the data signal lines $D_1$, $D_2$. Also the address signal lines $V_1$, $V_2$ are electrically connected, in groups of respective horizontal rows of pixels, to the gates of the switching transistors 7.

In FIG. 2, $C_{LC}$ and $C_S$ respectively indicate the equivalent capacitance of the liquid crystal pixel and the additional capacitance.

FIG. 3 is a timing chart showing an example of the output signal S' from the signal inverting circuit 30. The input signal S bearing image information is converted into the output signal S' by inversion by every 1H. In FIG. 3, $V_{LC}$ is the potential of the common electrode, $V_{DL}$ is the black level of the positive image signal, $V_{WL}$ is the white level thereof, $V_{DH}$ is the black level of the negative image signal, and $V_{WH}$ is the white level thereof.

As the signal inversion generates an image signal symmetrical to the common electrode potential $V_{LC}$, the entire signal amplitude ($V_{DL}$–$V_{DH}$) is equal to twice of ($V_{DL}$–$V_{LC}$), so that it becomes about 10V if the potential difference between $V_{DL}$ and $V_{LC}$ is about 5 V.

In the circuit shown in FIG. 2, if the switching transistors 7 and the horizontal transfer switches 22 are composed of p-MOS transistors, each transistor becomes non-conductive in response to an input signal of a voltage lower than the threshold voltage $V_{th}$ of said transistor. In most cases, for maintaining the non-conductive state in a range from the ground potential $G_{ND}$ to $V_{DL}$ in consideration of the operating margin, the voltage of the image signal S' becomes larger than the potential difference mentioned above. In the foregoing example, this signal voltage is usually taken as about 13 V or larger.

As the above-explained driving method involves a high driving voltage, a high voltage resistance is required in the driving devices for the liquid crystal display device, and a matching design is required for the wirings etc. This fact inevitably leads to a lowered production yield, a higher cost and a higher power consumption of the liquid crystal display device.

In order to overcome such drawbacks, there have been proposed methods as disclosed in the Japanese Patent Laid-open Application Nos. 54-98525 and 1-138590.

The method disclosed in the Japanese Patent Laid-open Application No. 54-98525 consists of inverting the common electrode potential $V_{LC}$ in synchronization with the inversion of the image signal S', thereby selecting a same amplitude range for the positive and negative image signals and reducing the entire signal amplitude range to about ½.

However, such method may lead to the following difficulty.

Usually the liquid crystal capacitance $C_{LC}$ is in the order of several ten fF, while the additional capacitance $C_S$ is about 100 fF. If the total capacitance for a pixel is 100 fF, the total capacitance of the entire liquid crystal display device becomes about 10,000 pF when it is applied to a television display, as there are at least required 100,000 pixels.

Consequently, for driving such liquid crystal display device for example with a signal amplitude range of ca. 7 V, there is required a high-speed pulse drive of a load capacitance of 10,000 pF with a potential difference of ca. 7 V. Such requirement inevitably results in an increased magnitude and an elevated cost of the driving circuits.

Besides, the number of pixels of the liquid crystal display device is increasing, for achieving color display or a higher image quality. For this reason the capacitance of the device will correspondingly increase, for example to 30,000 pF for 300,000 pixels, or 50,000 pF for 500,000 pixels, so that cost reduction and compactization of the driving circuits will become more difficult to achieve.

On the other hand, the method disclosed in the Japanese Patent Laid-open Application No. 1-138590 consists of employing separate common electrodes for the liquid crystal and for the additional capacitance, and applying an inversion potential to the common electrode of the liquid crystal.

Also this method results in a similar difficulty, as a high-speed drive is required for a total liquid crystal capacitance of several thousand pF for example for 100,000 pixels.

Besides, in this case, the image signal voltage $V_{LC}'$ applied to the liquid crystal for inverting the common electrode potential $V_{LC}$ for the liquid crystal of a capacitance smaller than the additional capacitance varies at maximum:

$$V_{LC} \times C_S/(C_{LC}+C_S).$$

Consequently, though a proper voltage can be applied at the entry of the image signal to the liquid crystal, such voltage can no longer be applied during the voltage-maintaining period.

Such difficulty may be overcome by selecting the additional capacitance $C_S$ sufficiently smaller than the liquid crystal capacitance $C_{LC}$, but, in such case, the total capacitance per pixel becomes too small for maintaining the signal voltage, so that satisfactory image display performance is difficult to obtain.

As explained in the foregoing, the conventional driving methods for the liquid crystal display device involves a very large signal voltage because of the threshold voltage $V_{th}$ of the transistors present in the display device and also because of the image signal amplitude extending in the positive and negative polarities, thereby requiring designs with high voltage resistance in the signal processing IC, drive pulse generating IC, liquid crystal display panel, other peripheral circuits and wirings, thus leading to a larger dimension and an elevated cost of the liquid crystal display device.

SUMMARY OF THE INVENTION

In consideration of the foregoing, an object of the present invention is to provide a driving method for the liquid crystal display device, enabling drive with a lower voltage, thereby allowing to achieve compactization and cost reduction of the liquid crystal display device.

Another object of the present invention is to provide a driving method for the liquid crystal display device provided with a plurality of pixels each of which is provided with a switching transistor for receiving a signal inverted at a desired interval and an additional capacitance for maintaining the signal voltage, wherein one of the electrodes of said additional capacitance is commonly connected for a desired block of said pixels, and the potential of said electrode is varied after the supply of said signal.

Still another object of the present invention is to provide a driving method for the liquid crystal display device for effecting display by entry of a signal, inverted at a desired interval, through switching transistors to pixels respectively provided with additional capacitances, wherein electrodes, one each, of said additional capacitances and electrodes, one each, of the pixels are commonly but mutually separately connected electrically in each of desired blocks of the pixels, while the other electrodes of said additional capacitances and the other pixel electrodes are respectively connected to said switching transistors in each of said desired blocks, and, in at least one of said desired blocks, after said signal is supplied to the other electrodes of said additional capacitances and the other pixel electrodes through said switching transistors in a state in which a desired potential is supplied to the other electrodes of said additional capacitances, a potential different from said desired potential is supplied to the other electrodes of said additional capacitances.

DETAILED DESCRIPTION OF THE PREFERRED EMBODIMENTS

The aforementioned objects can be attained by a driving method for the liquid crystal display device provided with a plurality of pixels each of which is provided with a switching transistor receiving the supply of a signal inverted at a desired interval and an additional capacitance for retaining the signal voltage, wherein electrodes, one each, of said additional capacitances are commonly connected in each of desired blocks of said pixels, and the potential of said electrodes in a desired pixel block is varied after the supply of said signal to said pixel block.

This method enables device drive with a low voltage and a high speed, thereby achieving reductions in size and cost of the liquid crystal display device.

In the following the driving method of the present invention will be clarified in detail, with reference to the attached drawings.

Embodiment 1

In this embodiment, the common electrodes for liquid crystal driving and those of the additional capacitances are electrically separated, and the above-mentioned common electrodes of the additional capacitances are further separated for each vertical column of pixels, whereby the voltages applied to the common electrodes of said additional capacitances are rendered independently controllable. Such separation of the common electrodes reduces the capacitance of each group of common electrodes for example to about 9 pF, in case of about 500 pixels in the horizontal direction, so that the high-speed drive is significantly facilitated.

In the following a more detailed explanation will be given with reference to a schematic equivalent circuit diagram shown in FIG. 4, schematic timing charts shown in FIGS. 5 and 6 and a wave form chart shown in FIG. 7.

Figure 1:
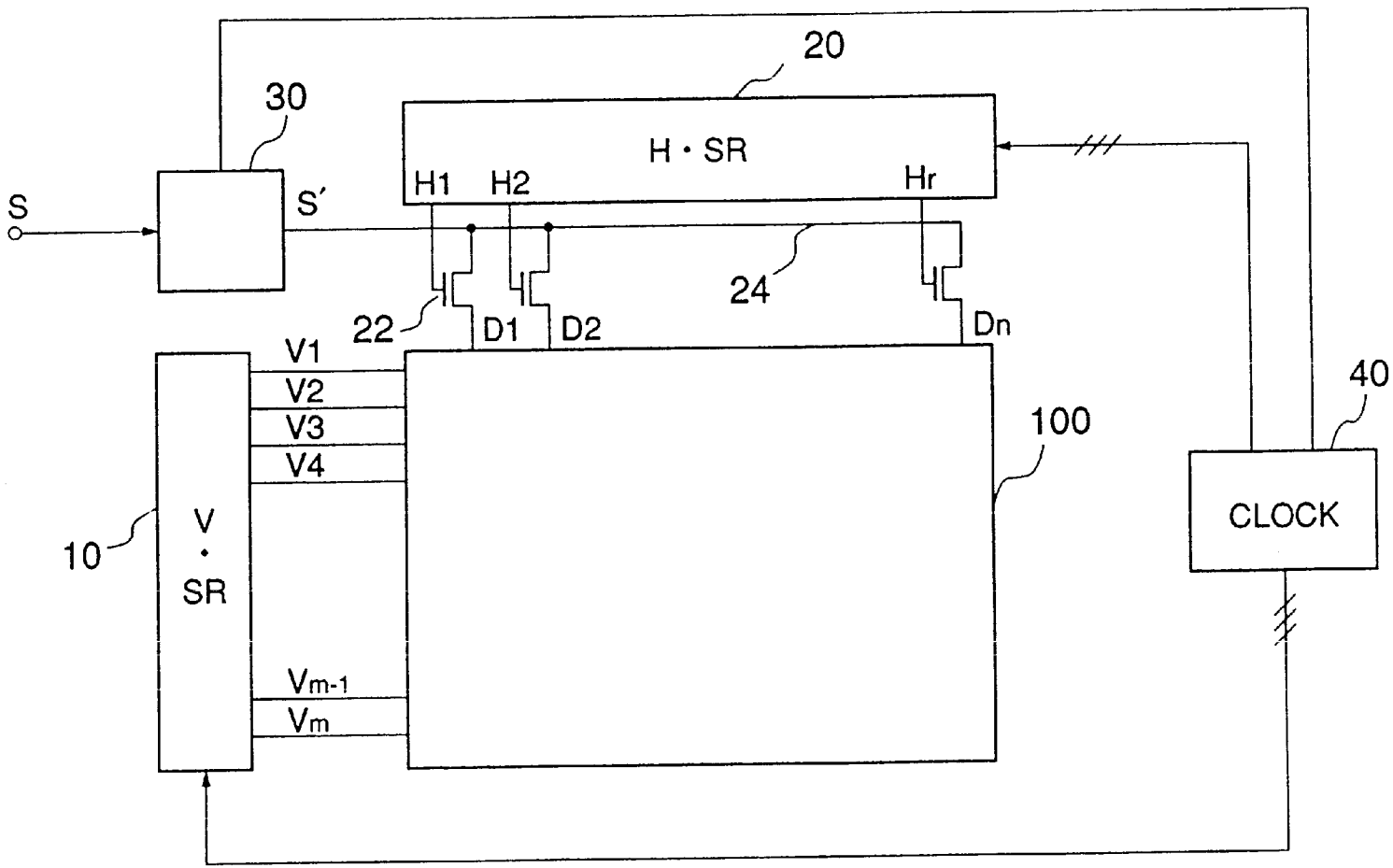
FIG. 1 is a view showing schematic configuration of a liquid crystal display device.
Figure 2:
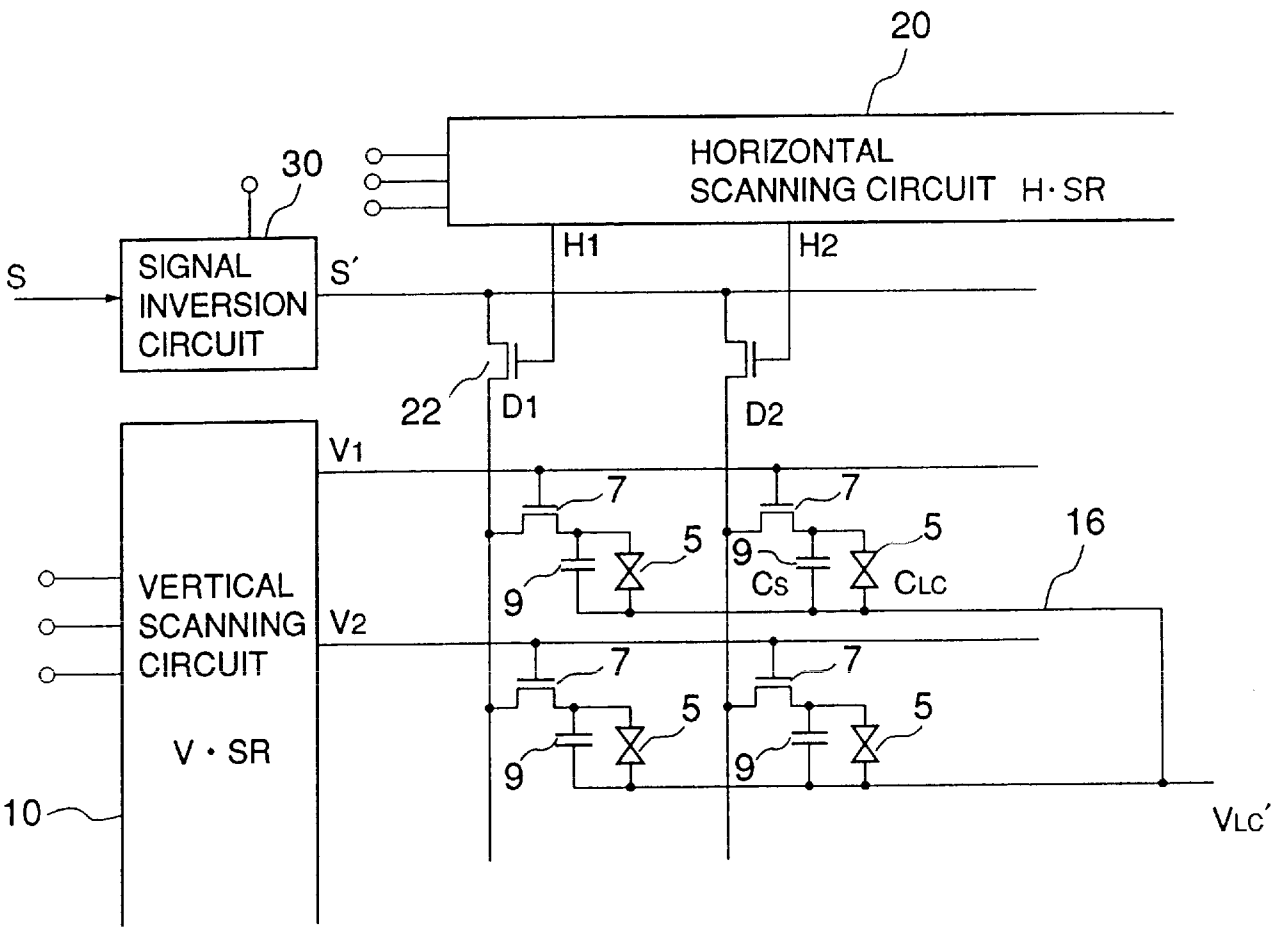
FIG. 2 is an equivalent circuit diagram of a liquid crystal display device.
Figure 3:
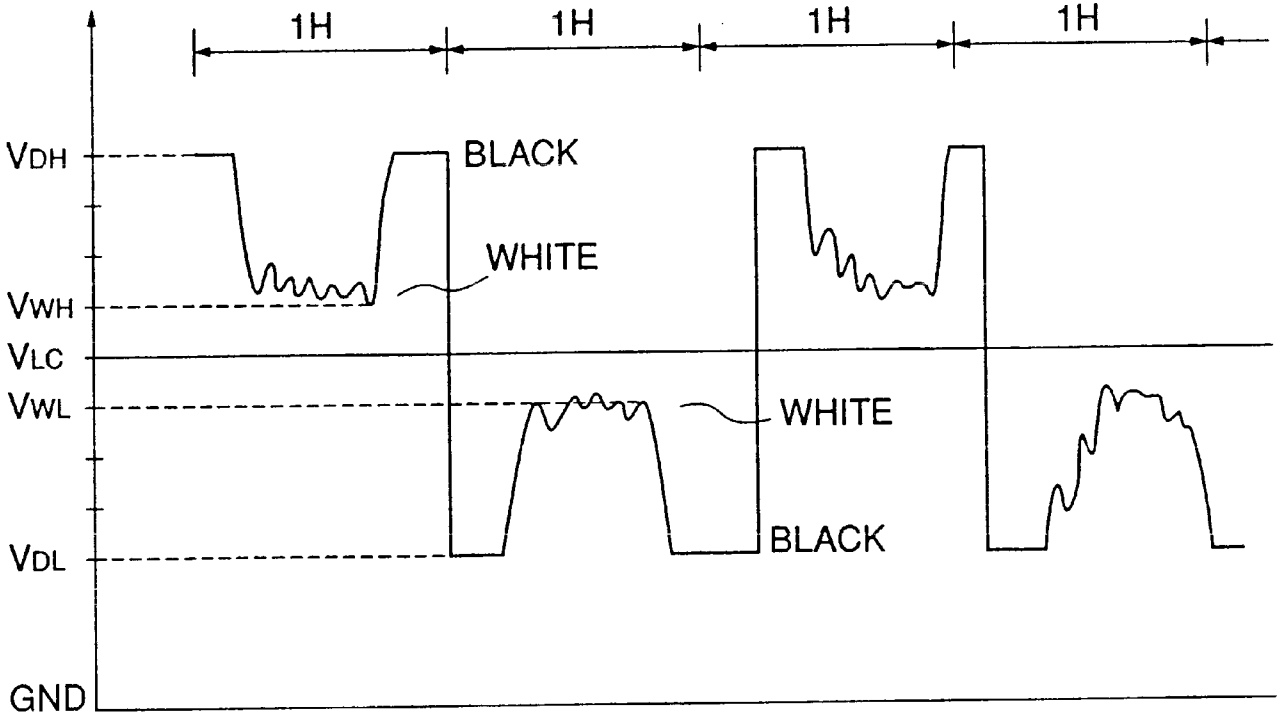
FIG. 3 is a timing chart showing an example of the image signal employed in the liquid crystal display device shown in FIG. 2.
Figure 4:
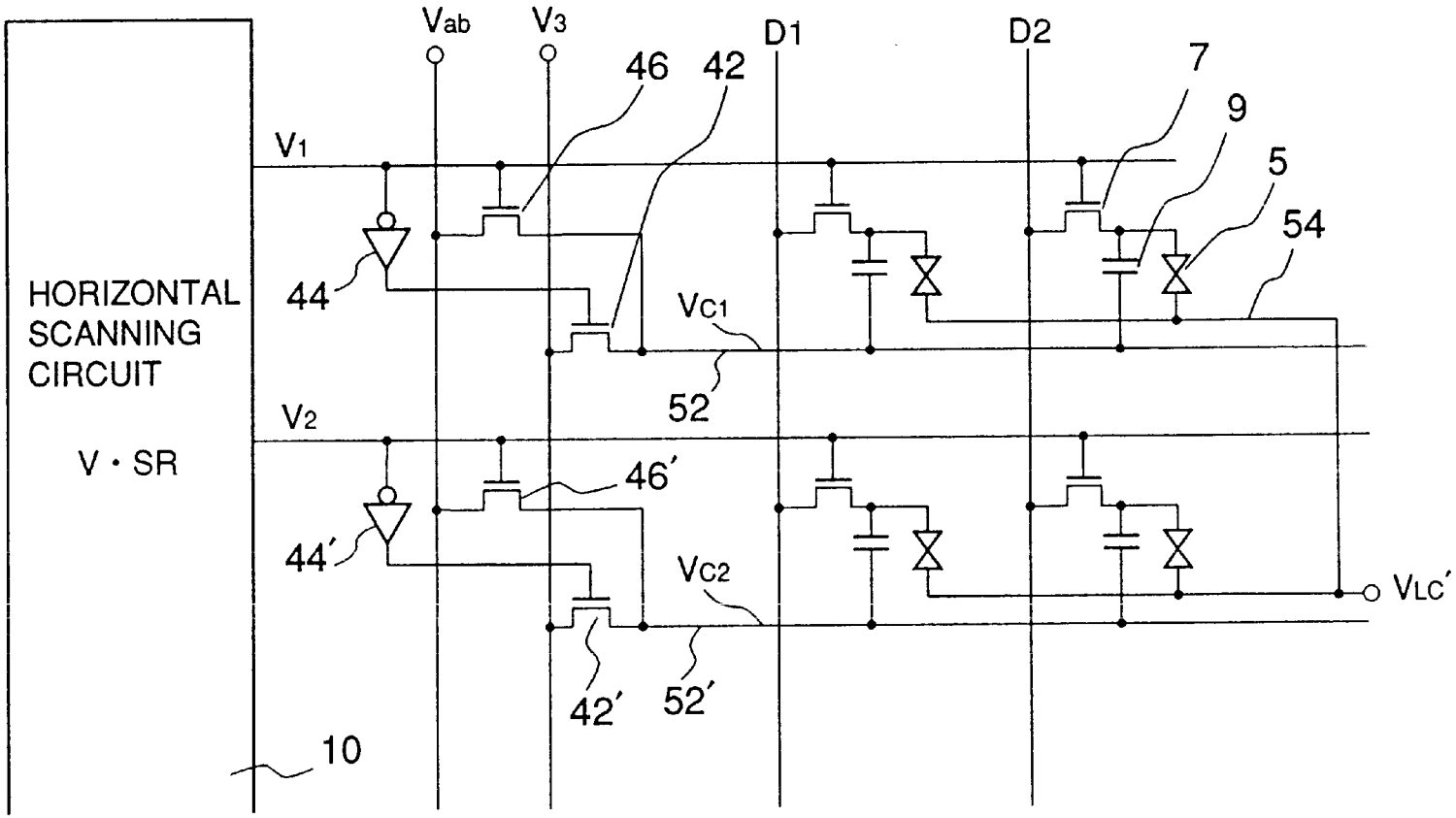
FIG. 4 is a schematic equivalent circuit diagram of a liquid crystal display device in which the present invention is applicable.

In FIG. 4 there are shown transistors 42, 42', 46, 46'; common electrode lines 52, 52' for additional capacitances 9; and a common electrode line 54 to which connected are those of a common potential among the display electrodes of the liquid crystal pixels. $V_{ab}$ and $V_3$ indicate potentials applicable to the common electrode lines 52, 52'.

The common electrode lines 52, 52', . . . , each commonly connected to the electrodes, one each, of the additional capacitances corresponding to the pixels of a horizontal row and thus constituting a block of pixels, are respectively connected to the transistors 42, 42'; 46, 46'; . . . controlled by the output of a vertical scanning circuit 10.

In this embodiment, said transistors 42, 42', 46, 46', . . . are of p-MOS type, and each of address lines $V_1$, $V_2$, . . . receives, from the vertical scanning circuit 10, an L-level pulse in a selected state or an H-level pulse in a non-selected state. Thus the voltage $V_{C1}$ of the common electrode line 52, common to the additional capacitances 9, becomes equal to $V_{ab}$ or $V_3$ respectively when the address line $V_1$ is selected or not selected by the vertical scanning circuit 10.

Figure 5:
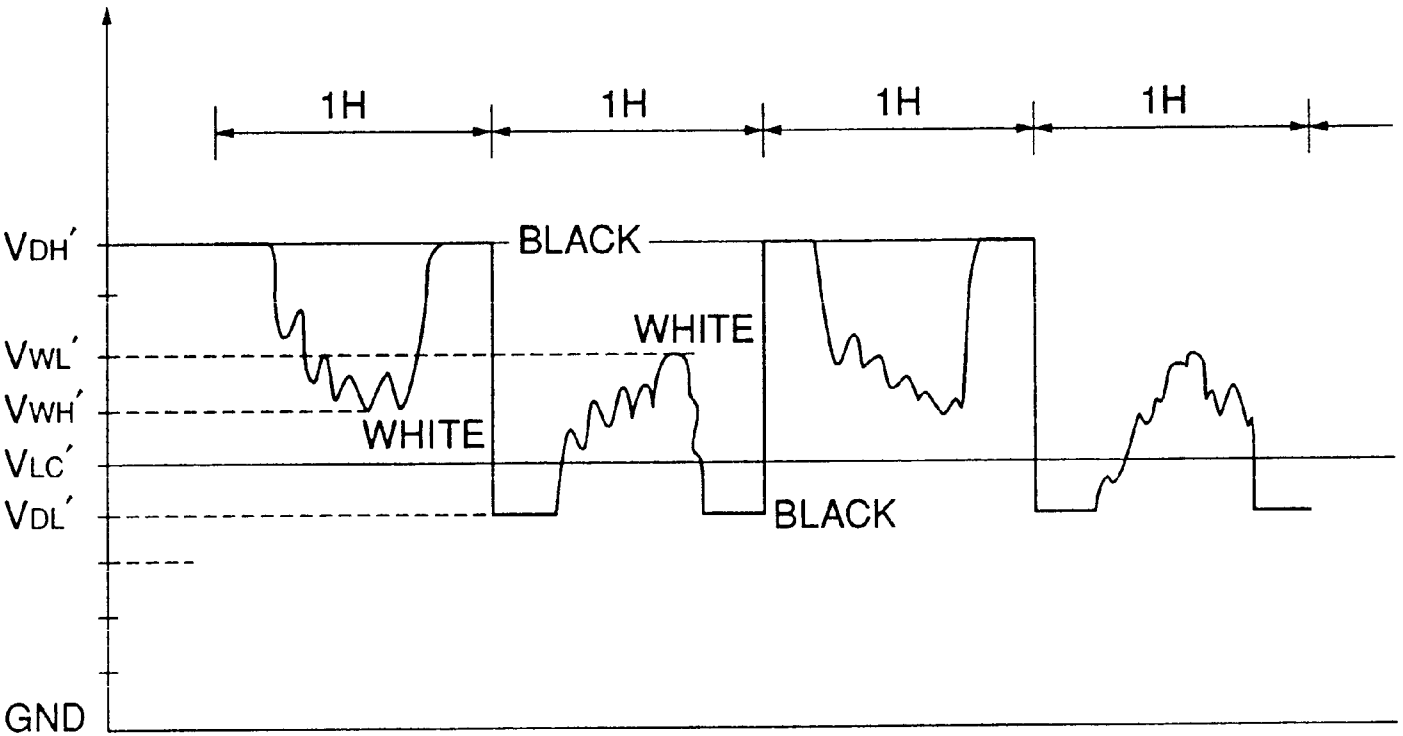
FIG. 5 is a schematic timing chart showing an example of the image signal employed in the present invention.
Figure 6:
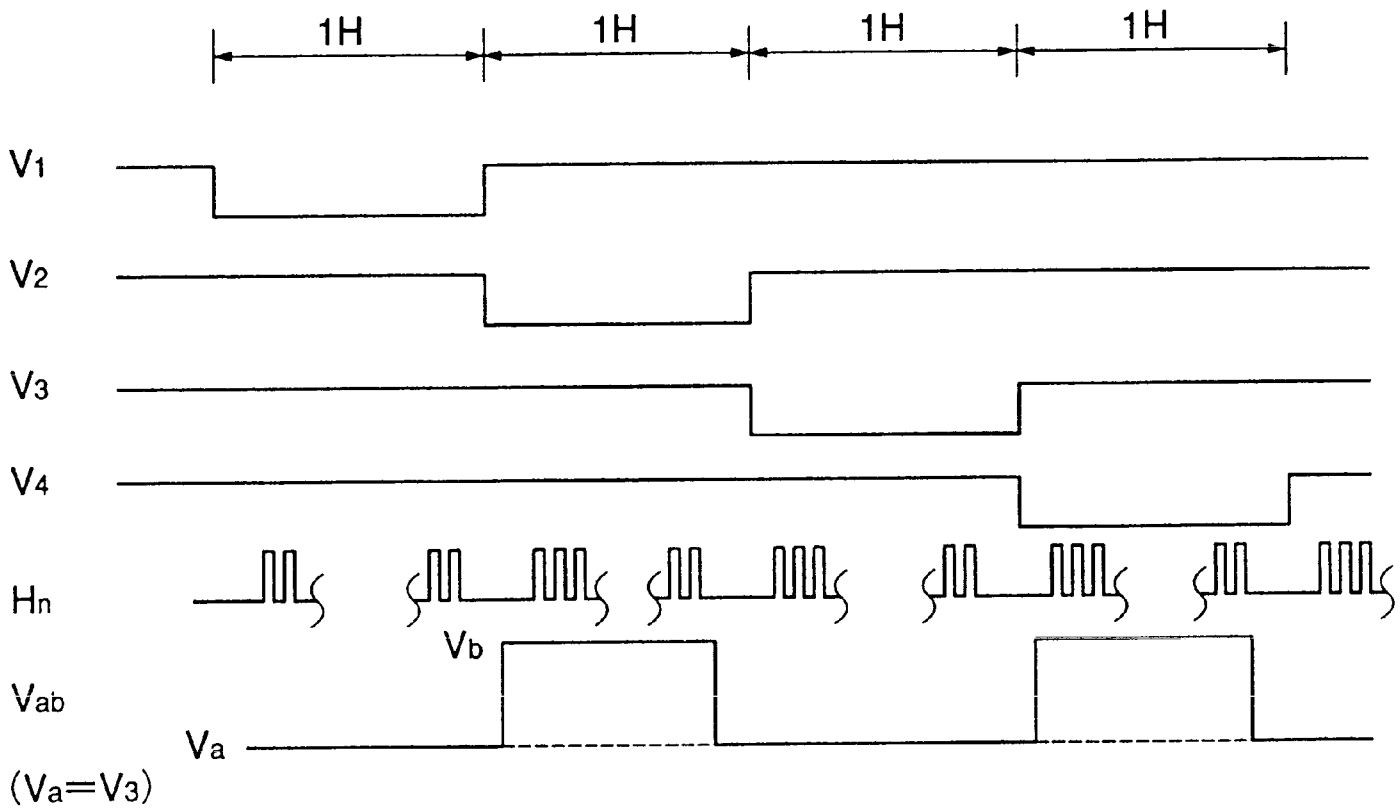
FIG. 6 is a schematic timing chart showing an example of the driving pulses of the present invention.

In the present embodiment, as shown in FIGS. 5 and 6, the common electrodes 54 of the liquid crystal cells 5 receive a voltage $V_{LC}'$, while the voltage $V_{ab}$ assumes a potential $V_a$ or $V_b$, and the voltage $V_3$ assumes a potential $V_a$.

Consequently, when the address line $V_1$ is selected, the common electrode line 52 receives the voltage $V_a$, and, in response to the horizontal scanning pulses $H_n$, negative image signals within a range of $V_{WH}'$ to $V_{DH}'$ are supplied, in succession, to the liquid crystal cells 5 and the additional capacitances 9, through the lines $D_1$–$D_n$ and the switching transistors 7.

Then, when the address line $V_2$ is selected (address line $V_1$ being shifted to the non-selected state), the address line $V_1$ assumes the H-level potential, and the voltage $V_{C1}$ of the common electrode line 52 is shifted from $V_{ab}$ (=$V_a$) to $V_3$. However, the voltage $V_{C1}$ in fact does not vary, because $V_{ab}=V_3=V_1$.

Figure 7:
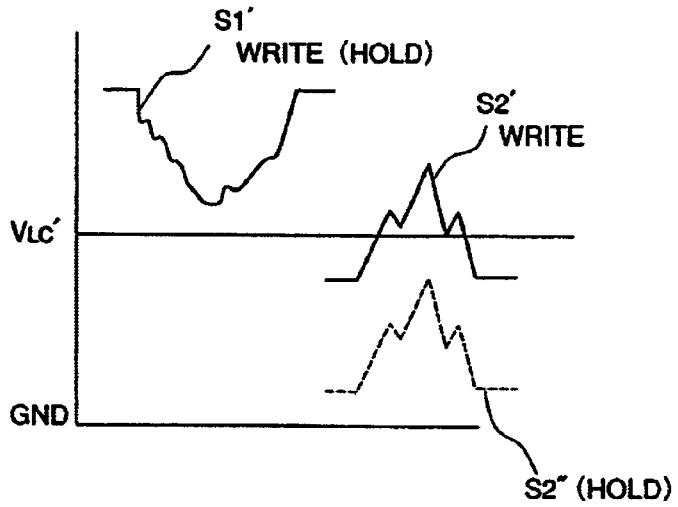
FIG. 7 is a wave form chart showing an example of the signals employed in the present invention.

Consequently, the pixels belonging to the address line $V_1$ retain the signal voltage same as at the signal entry, because of the non-conductive state of the transistors 7, so that the voltage applied to the liquid crystal remains unchanged (cf. $S_1'$ in FIG. 7).

On the other hand, by the selection of the address line $V_2$, the voltage $V_{C2}$ of the common electrode line 52' assumes a value $V_{ab}=V_b$, and, in response to the horizontal scanning pulses $H_n$, the positive image signals within a range of $V_{DC}'$ to $V_{WL}'$ are similarly supplied to the liquid crystal cells.

The image signals of said range $V_{DC}'$–$V_{WL}'$ are represented by voltages larger than the common electrode voltage $V_{LC}'$ for the liquid crystal 5, approximately by a range of $V_{WL}'$ to $V_{DL}'$. When the next vertical address line is selected after the scanning of the pixels corresponding to the address line $V_2$, the vertical address line $V_2$ assumes the H-level state, whereby the voltage $V_{C2}$ assumes the potential $V_3=V_a$.

In this manner the voltage $V_{C2}$ becomes $V_b$ at the application of the image signal, and is shifted to $V_a$ while the image signal is retained. This potential shift of $-(V_b-V_a)$ causes the liquid crystal 5 to receive the image signal of a proper voltage (cf. $S_2''$ in FIG. 7).

The application of unshifted "improper" voltage at the image signal application does not detrimentally affect the image display performance, because the period of such application is extremely shorter than the signal retaining period and also because the response of the liquid crystal to the signal is slower.

More specifically, the period of application of such unshifted improper voltage is about 50 μsec. at maximum, while the signal retaining period is about 17 to 33 msec., and the response of liquid crystal to the signal requires several to several ten milliseconds.

As explained in the foregoing, the present embodiment shifts the voltage of the positive image signals by about $V_{WL}'$–$V_{DL}'$, thereby correspondingly compress the entire signal voltage amplitude.

Stated differently, the non-conductive portion of the signal resulting from the threshold voltage $V_{th}$ of the p-MOS transistor is compensated by the above-mentioned shift of the signal voltage.

Embodiment 2

Figure 8:
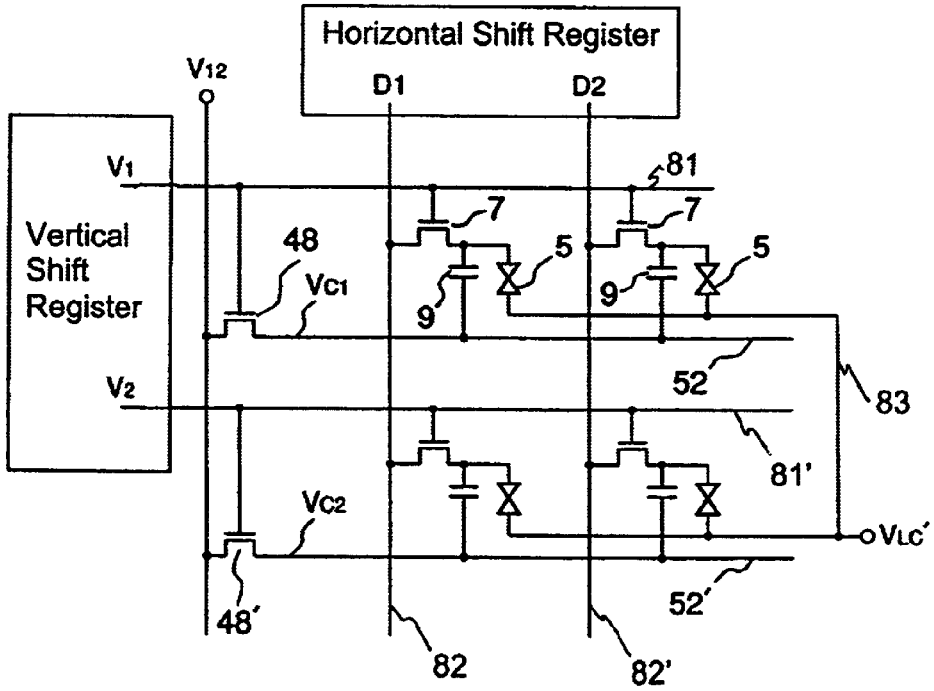
FIG. 8 is a schematic equivalent circuit diagram of a liquid crystal display device in which the present invention is applicable.

In this embodiment, as shown in a schematic equivalent circuit diagram in FIG. 8, the voltages of the common electrode lines 52, 52', . . . of the additional capacitances 9 are controlled by transistors 48, 48', . . .

In FIG. 8, a first plural wiring group comprising plural wirings 81 and 81' connects commonly gate terminals of the transistors 7 on each of the rows. A second wiring group comprising plural wirings 82 and 82' connects commonly source terminals of the transistors 7 on each of the columns. A common electrode 83 connects commonly the second capacitors, or liquid crystal, 5 connected to the drain terminals of the transistors 7 on the rows and columns.

This embodiment will be explained further in the following, with reference also to a schematic timing chart in FIG. 9.

In this embodiment, the voltages $V_{C1}$, $V_{C2}$, . . . to be applied to the common electrode lines 52, 52', . . . are controlled by the transistors 48, 48', . . . connected electrically thereto. In this embodiment, the common electrode line for the pixels corresponding to the selected vertical address is given a voltage $V_{ab}$ , but, in the non-selected state, is maintained in a floating state with the voltage $V_{ab}$ .

Figure 9:
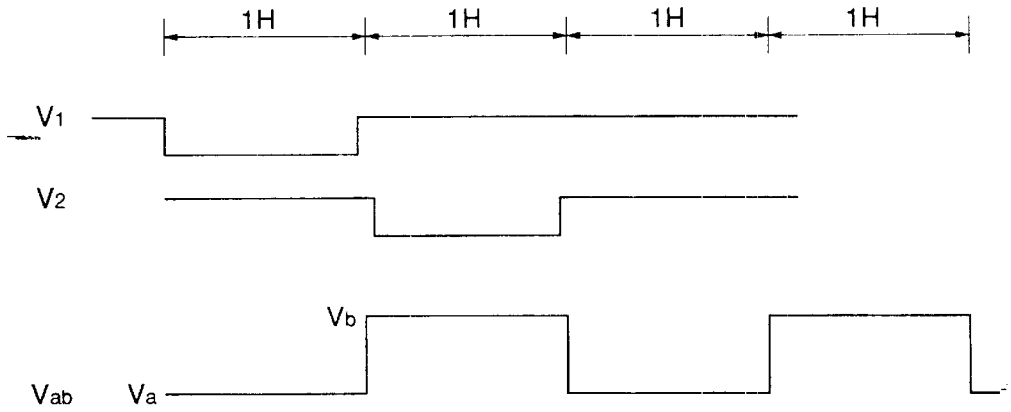
FIG. 9 is a schematic timing chart showing an example of the driving pulses employed in the present invention.

Referring to FIG. 9, when the vertical address line $V_1$ is selected, the transistor 48 is turned on to apply $V_{ab}$ (=$V_a$) as the voltage $V_{C1}$ of the common electrode line 52. Then, when the vertical address line $V_2$ is selected and the vertical address line $V_1$ is shifted to the non-selected state, the transistor 48 is turned off whereby the common electrode line 52 is maintained in the floating state with a voltage $V_a$ while the transistor 48' is turned on to apply $V_{ab}$ (=$V_b$) to the common electrode line 52'.

The liquid crystal 5 can thus be driven with the signals as shown in FIG. 5, by means of such voltage $V_{ab}$ and the on/off operations of the transistors.

As explained in the foregoing, this embodiment can reduce the signal voltage amplitude as in the first embodiment, however, with a reduced number of transistors.

Embodiment 3

Figure 10:
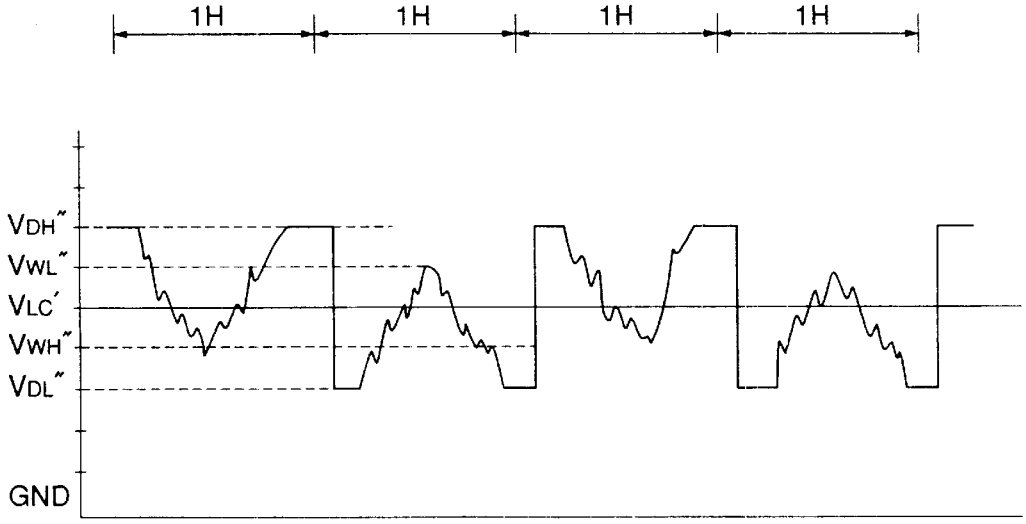
FIG. 10 is a schematic timing chart showing an example of the image signal employed in the present invention.
Figure 11:
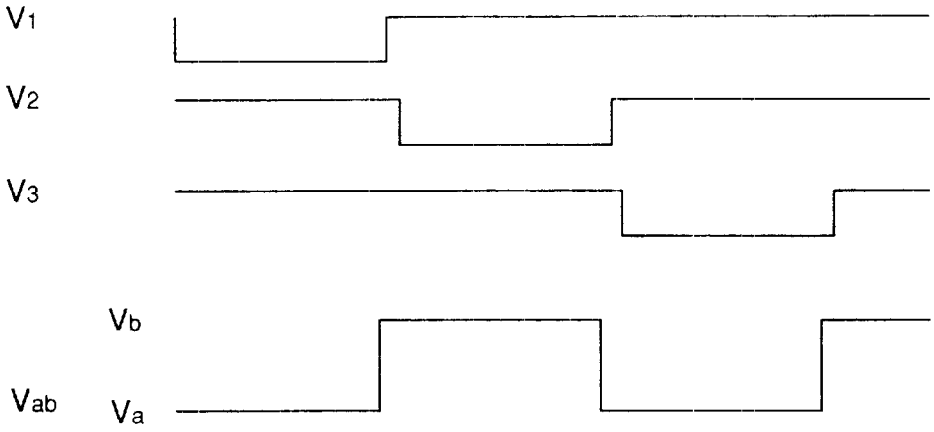
FIG. 11 is a schematic timing chart showing an example of the driving pulses employed in the present invention.

This embodiment further reduces the signal voltage amplitude as will be explained in the following with reference to timing charts shown in FIGS. 10 and 11.

In this embodiment, the image signals of positive and negative polarities are so selected as to overlap with the common electrode voltage of the liquid crystal, thereby further reducing the entire signal voltage range by such overlapping portion.

More specifically, when the vertical address line $V_1$ is selected, the negative image signals are applied with $V_{C1}=V_a$, and the voltage is shifted to $V_{C1}=V_b$ after said application, whereby a proper voltage is applied during the signal retaining phase. Similarly, when the vertical address line $V_2$ is selected, the positive image signals are applied with $V_{C2}=V_b$, and the voltage is shifted to $V_{C2}=V_a$ after said application, whereby a proper voltage is applied during the signal retaining phase.

Such voltage shift after the voltage application at the entry of image signals into the pixels allows to apply a desired voltage to the liquid crystal and to further reduce the signal voltage range.

In summary, the present invention is to reduce the amplitude of the input image signals, utilizing a variation in the voltage of the common electrodes of the additional capacitances between the write-in phase of the image signals and the signal retaining phase, and is not limited to the foregoing embodiments as long as the above-mentioned condition is met. For example it is applicable to the interlace drive with different combinations of vertical scanning operations, or to various image input methods such as dot-sequential input method or collective input method utilizing temporary retaining capacitances.

As explained in the foregoing, the driving method of the present invention, being capable of reducing the range of the input image signals through the control of the common electrode potential of the additional capacitances in the liquid crystal display device, allows to employ a lower voltage in the designing of liquid crystal panel and peripheral IC's, thereby achieving reductions in size, cost and power consumption of the display device.

What is claimed is:

1. A liquid crystal display device comprising:

a matrix wiring of row wirings and column wirings;

a liquid crystal pixel element at each cross point of the matrix wiring, the pixel element comprising a liquid crystal cell, switching transistor, and capacitor, a first terminal of the cell and a first terminal of the capacitor being connected at a joint point, which is in turn connected to one of the column wirings through the switching transistor, and a second terminal of the cell being connected to a reference potential;

a video signal drive circuit for applying a video signal to each of the column wirings through a transfer switch;

a selection signal drive circuit for applying a selection signal sequentially to each of the row wirings, the selection signal drive circuit, in cooperation with the video signal drive circuit, applying the video signal to the joint point of each pixel element through the transfer switch and the switching transistor to charge the capacitor of each pixel element by the video signal, wherein the video signal is a modified video signal derived from a normal video signal comprising an inverted video signal and a non-inverted video signal, said deriving occuring by shifting the DC level, or levels, of the inverted video signal and/or the non-inverted video signal so that the amplitude width of the modified video signal is narrower than that of the normal video signal; and a control circuit for applying a first potential to a second terminal of the capacitor at each pixel element in a first group for a first period, while the video signal is being applied to the joint point associated with each pixel in said first group, and for applying a second potential to the second terminal of the capacitor at each pixel element in a second group for at least part of a second period, while the video signal is not being applied to the joint point associated with each pixel element in said second group, wherein the first potential and the second potential are selected so that a charge built up in the capacitor at each pixel element in said second group provides a potential at the associated joint point which corresponds to the normal video signal by compensating for a DC shift in the second period.

2. The liquid crystal device according to claim 1, wherein in the modified video signal, a DC level in either one of the inverted video signal or non-inverted video signal is shifted, and wherein, for the capacitor associated with the cell to which the video signal without DC level shift is applied, the first potential is equal to the second potential.

3. The liquid crystal device according to claim 1, wherein the inverted video signal and the non-inverted video signal have a period corresponding to one horizontal scanning period, respectively.

4. The liquid crystal device according to claim 3, wherein the first period corresponds to the horizontal scanning period.

5. The liquid crystal device according to claim 1, wherein the first period corresponds to a period while the transfer switch is being turned on.

6. The liquid crystal device according to claim 1, wherein the inverted video signal is inverted with respect to the reference potential for the normal video signal.

7. The liquid crystal device according to claim 1, wherein the control circuit applies the first potential to a common line which is connected to the second terminal of the capacitor at each of pixel elements associated with the row wiring to which the selection signal is being applied, and applies the second potential to common lines which are connected to the second terminal of the capacitor at each of pixel elements associated with the row wirings to which the selection signal is not being applied.

8. A liquid crystal display device comprising:

a matrix wiring of row wirings and column wirings;

a liquid crystal pixel element at each cross point of the matrix wiring, the pixel element comprising a liquid crystal cell, switching transistor, and capacitor, a first terminal of the cell and a first terminal of the capacitor being connected at a joint point, which is in turn connected to one of the column wirings through the switching transistor, and a second terminal of the cell being connected to a reference potential;

a video signal drive circuit for applying a video signal to each of the column wirings through a transfer switch;

a selection signal drive circuit for applying a selection signal sequentially to each of the row wirings, the selection signal drive circuit, in cooperation with the video signal drive circuit, applying the video signal to the joint point of each pixel element through the transfer switch and the switching transistor to charge the capacitor of each pixel element by the video signal, wherein the video signal is a modified video signal derived from a normal video signal comprising an inverted video signal and a non-inverted video signal, said deriving occurring by shifting the DC level, or levels, of the inverted video signal and/or the non-inverted video signal so that the amplitude width of the modified video signal is narrower than that of the normal video signal; and a control circuit for applying (1) a first potential to a first common line connected to a second terminal of the capacitor at each pixel element in a first group for a first period, while the switching transistor is in an ON state and the video signal is being applied to the joint point associated with each pixel element in said first group, (2) a second potential to a second common line connected to a second terminal of the capacitor at each pixel element in a second group for a second period, while the switching transistor is in an ON state and the video signal is being applied to the joint point associated with each pixel element in said first group, and (3) the first potential to the second common line connected to the second terminal of the capacitor at each pixel element in said second group for a third period, while the switching transistor is in an ON state and the video signal is not being applied to the joint point associated with each pixel element in said second group, wherein the first potential and the second potential are selected so that a charge built up in the capacitor at each pixel element in said second group provides a potential at the associated joint point which corresponds to the normal video signal by compensating for a DC shift in the third period.

* * * * *

UNITED STATES PATENT AND TRADEMARK OFFICE

CERTIFICATE OF CORRECTION

PATENT NO. : 6,683,591 B2 
DATED : January 27, 2004
INVENTOR(S) : Seiji Hashimoto et al.

It is certified that error appears in the above-identified patent and that said Letters Patent is hereby corrected as shown below:

Column 5,
Line 59, "$V_{ab}=V_3=V_1$." should read -- $V_{ab}=V_3=V_a$. --.

Signed and Sealed this

Twentieth Day of September, 2005

JON W. DUDAS
*Director of the United States Patent and Trademark Office*